United States Patent [19]

Shibata

[11] Patent Number: 5,005,392

[45] Date of Patent: Apr. 9, 1991

[54] SWITCH DEVICE IN CAR LOCK DEVICE

[75] Inventor: Thoru Shibata, Utsunomiya, Japan

[73] Assignee: Mitsui Kinzoku Kogyo Kabushiki Kaisha, Tokyo, Japan

[21] Appl. No.: 537,970

[22] Filed: Jun. 14, 1990

[30] Foreign Application Priority Data

Jun. 22, 1989 [JP] Japan ..... 1-160238

[51] Int. Cl.[5] ..... E05B 65/36

[52] U.S. Cl. ..... 70/264; 292/201; 292/336.3

[58] Field of Search ..... 70/264, 257; 292/201, 292/DIG. 3, 336.3

[56] References Cited

U.S. PATENT DOCUMENTS 2,186,546 1/1940 Lakin ..... 70/264

4,364,249 12/1982 Kleefeldt ..... 70/264

*Primary Examiner*—Lloyd A. Gall

*Attorney, Agent, or Firm*—Browdy and Neimark

[57] ABSTRACT

A switch device in a car lock device includes a lock lever disposed between a body and a back plate, rotating with a center shaft in a longitudinal direction being its axis of rotation and switching the lock device to a lock state and an unlock state, and a switch member fitted to the outer surface of the back plate, having a rotary shaft on the same axis as the center shaft, connected electrically to the lock devices of other doors and sending switching signals of the lock state and unlock state to the other locking devices. A switch arm which rotates between the lock position and the unlock position and is equipped at one of its ends with an engagement hole is fixed to the rotary shaft. An arcuate hole having its center on the center shaft is formed at one of the ends of the lock lever. One of the ends of the a rod whose other end is interconnected to a key cylinder is meshed with the arcuate hole of the lock lever and with the engagement hole of the switch arm. The arcuate hole has a length which is half the moving distance of the engagement hole of the switch arm by the key cylinder.

1 Claim, 4 Drawing Sheets

SWITCH DEVICE IN CAR LOCK DEVICE

FIELD OF THE INVENTION

This invention relates to a car lock device. More particularly, the present invention relates to a switch device for switching simultaneously a plurality of lock devices disposed in a plurality of doors to a lock state and an unlock state.

BACKGROUND OF THE INVENTION

A car lock device for changing the lock state and unlock state of a lock device by an actuator of a motor, or the like, has been known in the past. In the lock devices of this kind, a switch device which is changed over by a key cylinder or a sill knob is fitted to the lock device of the door of a driver's seat so that the lock devices of all the other doors are switched either to the lock state or the unlock state when this switch device is changed over.

The switch device described above is fitted to the outer surface of the lock device. For, after the smallest original lock as the basis is formed, additional functions are added to it so as to form the lock device. Accordingly, if the switch device is fitted into the lock device from the beginning, the original lock becomes great as much in size.

SUMMARY OF THE INVENTION

It is therefore an object of the present invention to provide a lock device having fitted thereto efficiently the switch member described above.

DESCRIPTION OF THE PREFERRED EMBODIMENT

Figure 1:
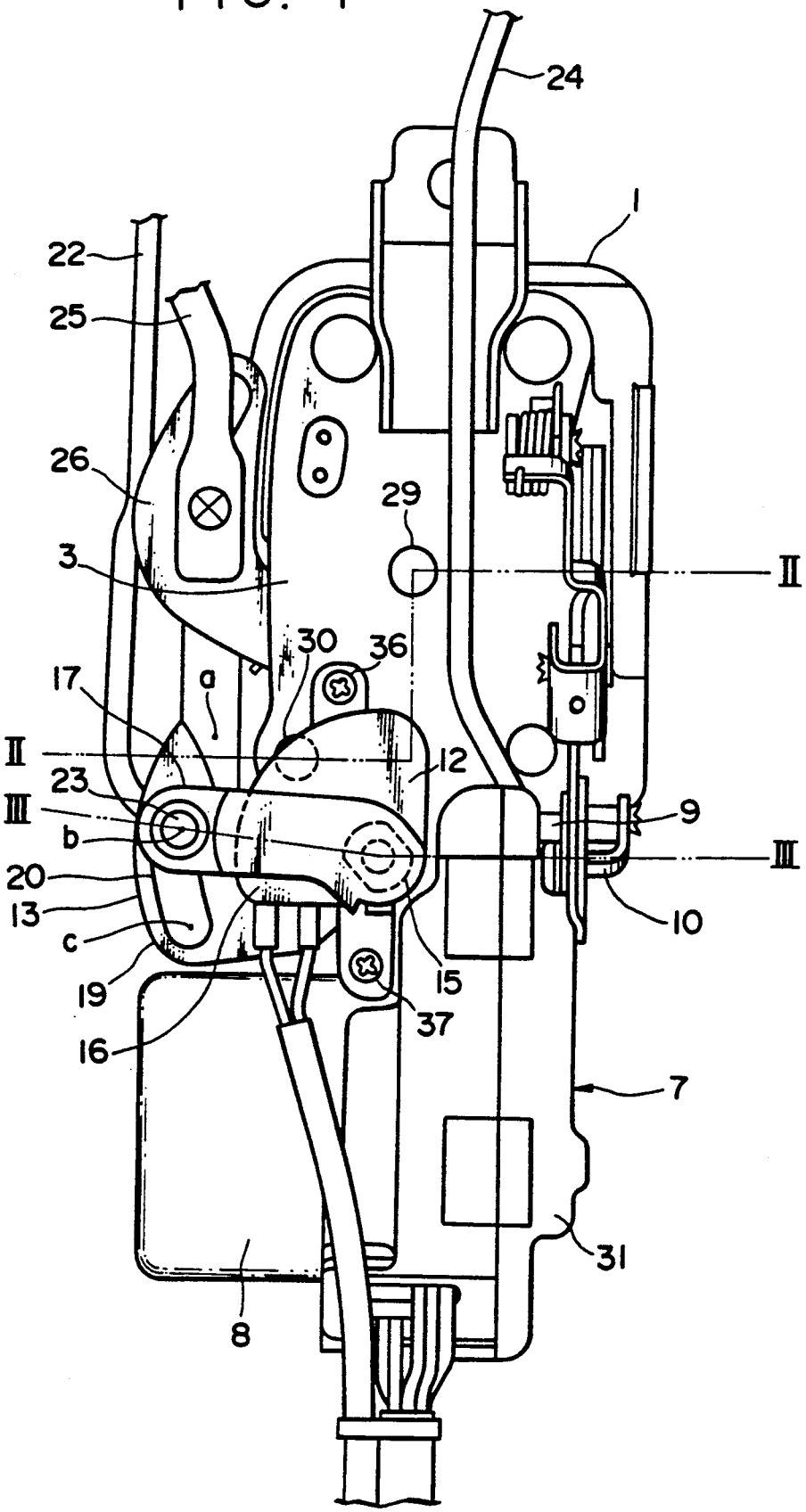
FIG. 1 is a rear view of a lock device in accordance with the present invention.
Figure 2:
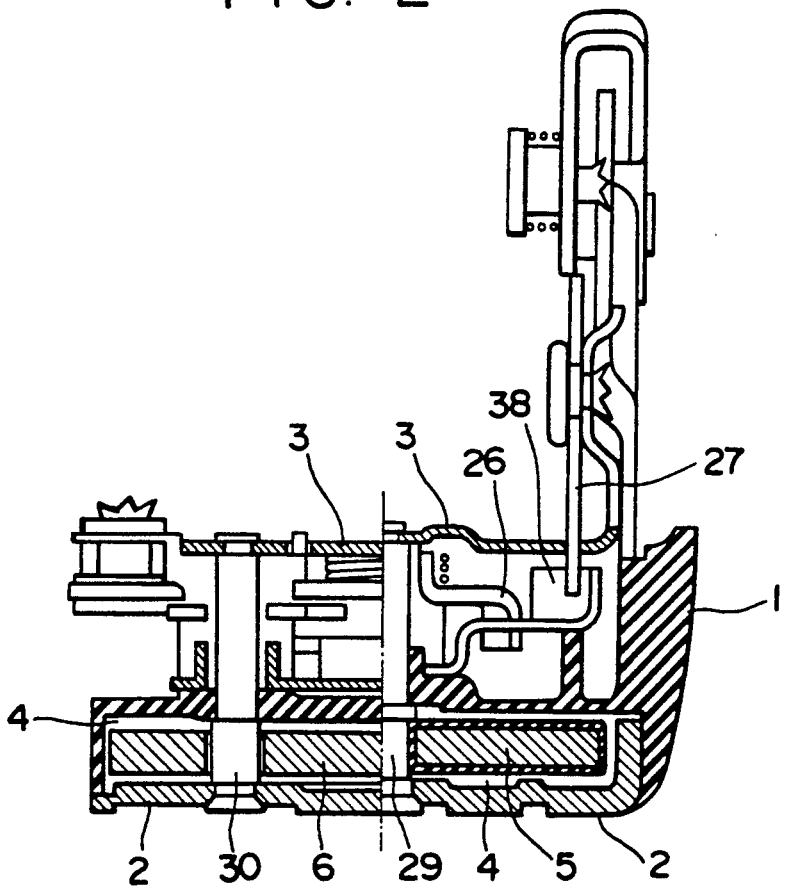
FIG. 2 is a sectional view taken along line II—II of FIG. 1.

Hereinafter, a preferred embodiment of the present invention will be explained with reference to the drawings. The lock device shown in the drawings is a lock device adjacent a driver's seat, and comprises a synthetic resin body 1, a metallic cover plate 2 fixed to the surface of the body 1 and a metallic back plate 3 fixed to the back of the body 1.

A recess 4 is formed on the surface side of the body 1 and a latch 5 meshing with a striker (not shown in the drawing) fixed to a car body side is supported by a shaft 29 inside the recess 4. A ratchet 6 meshing with the latch 5 and preventing its reverse rotation is also supported by a shaft 30 inside the recess 4. The engagement between the latch 5 and the ratchet 6 can be released when an open lever 26 interconnected to a rod 25 through an outer open handle (not shown) of the door is rotated.

An actuator box 7 made of a synthetic resin is formed at the lower part of the body 1. The body 1 and the box 7 may be formed either integrally with, or separately from, each other. The box 7 includes a motor chamber 8 for storing therein a motor and a gear chamber 31 for storing reduction gears. A rotary lever 10 is fixed to an output shaft 9 which projects sideways from the gear chamber 31.

A lock lever 11 for switching the lock device to a lock state and an unlock stage is supported rotatably by a shaft 12 at the lower part of the back plate 3. This lock lever 11 is disposed between the plate 3 and the body 1.

Figure 3:
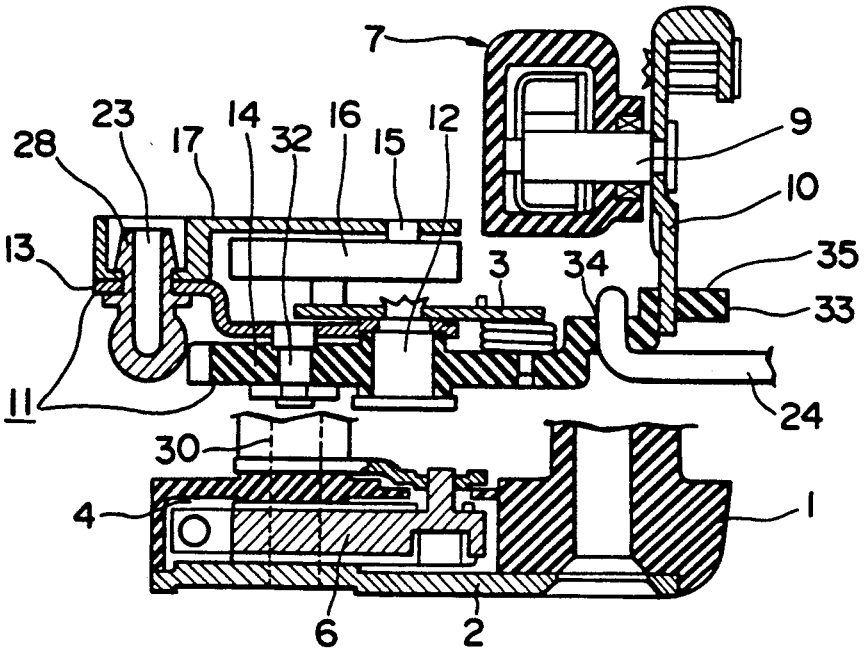
FIG. 3 is a sectional view taken along line III—III of FIG. 1.
Figure 4:
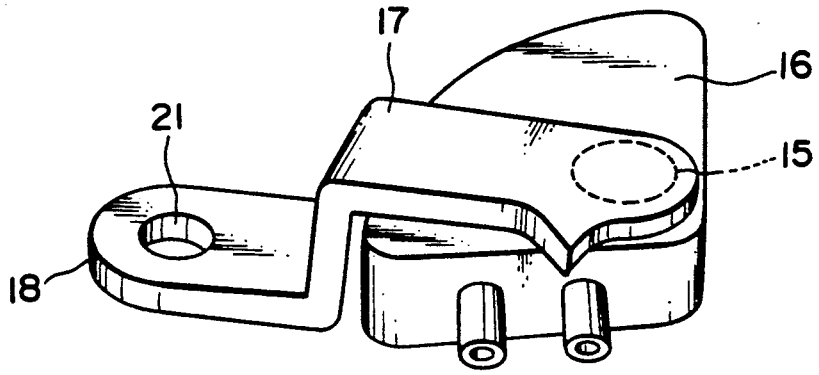
FIG. 4 is a perspective view of a switch box and a switch arm.
Figure 5:
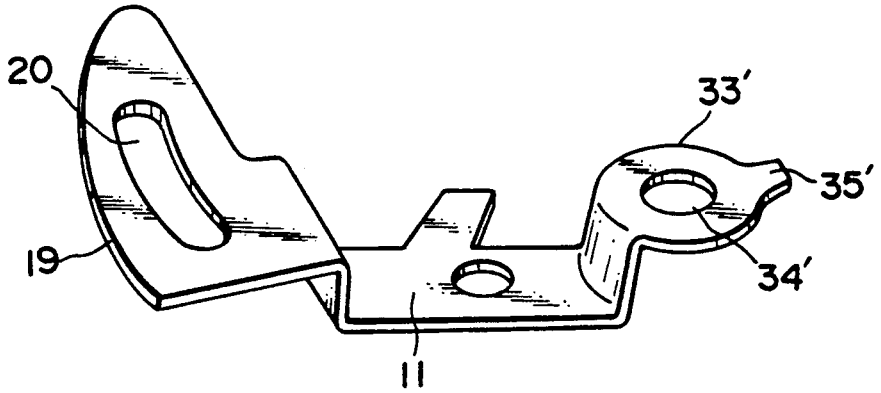
FIG. 5 is a perspective view of another example of a lock lever.
Figure 6:
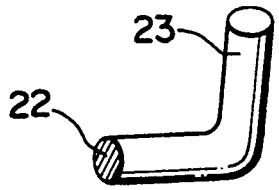
FIG. 6 is a perspective view of the tip portion of a rod.
Figure 7:
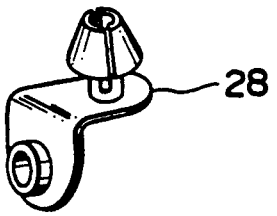
FIG. 7 is a perspective view of a rod connecting member.

The lock lever 11 consists of a first lock lever 13 made of a metal and a second lock lever 14 made of a synthetic resin and interconnected to the first lock lever 13 by a pin 32, as shown in FIG. 3. The split type is more economical and the lock lever may therefore be a single lock lever as shown in FIG. 5.

The shaft 12 of the lock lever 11 is a short shaft having its axis in the longitudinal direction as shown in FIG. 3. Its front side does not reach the body 1 and its rear side is caulked to the plate 3.

An arcuate hole 20 having its center at the shaft 12 is formed at the rotary end portion 19 of the first lock lever 13 and a round hole 34 and a protuberance 35 are formed at the rotary end portion 33 of the second lock lever 14. One of the ends of the rod 24, which is interconnected to an inner lock (sill knob), is anchored to the round hole 34 and the rotary lever 10 of the actuator is meshed with the protuberance 35.

A switch box 16 incorporating therein a switch member is disposed on the back of the back plate 3 in such a manner that the axis of the rotary shaft 15 of the box 16 is on the same line as the axis of the rotary shaft 12 of the lock lever 11. The switch member described above is connected electrically to the lock devices of other doors. The switch member switches to three positions, i.e. a lock position, an unlock position and a neutral position, and sends switch signals of the lock state and unlock state to the other doors in accordance with its positions.

The switch box 16 is connected to the back plate 3 by a screw 36 and to the actuator box 7 by a screw 37, respectively. The rotary shaft 15 projects outward from the box 16 and the base portion of the switch arm 17 is fixed to this projecting portion. The rotary end portion 18 of the switch arm 17 extends to the position where it superposes with the rotary end portion 19 of the first lock lever 13. An engagement hole 21 is formed at the rotary end portion 18 and the tip 23 of the rod 22 interconnected to a key cylinder is meshed with this engagement hole 21 and with the arcuate hole 20 described above through a connecting member 28.

The tip 23 is positioned at the neutral position b when the key cylinder is inoperative, moves up to the lock position a when the key cylinder is rotated to the lock side and moves down to the unlock position c when the key cylinder is rotated to the unlock position. The arcuate hole 20 has a length equal to the distance between the lock position a or the unlock position c and the neutral position b.

Reference numeral 27 represents a lever which is rotated by an inner open handle and reference numeral 38 represents an intermediate lever which connects the lever 27 to the open lever 26.

Next, the functions will be explained.

FIG. 1 shows the state where the door is closed. The lock lever 11 is at the unlock position and the switch arm 17 is at the neutral position b.

When the key cylinder is rotated by the key to the lock side under this state, the tip 23 of the rod 22 rises to the lock position a, the first and second lock levers 13, 14 rotate with the shaft 12 being the center and the switch arm 17 rotates with the shaft 15 being the center. They displace then to the lock position and enter the state shown in FIG. 8. Since the shafts 12 and 15 are disposed on the same axis, the rotation of the lock lever and arm can be made smoothly.

Figure 8:
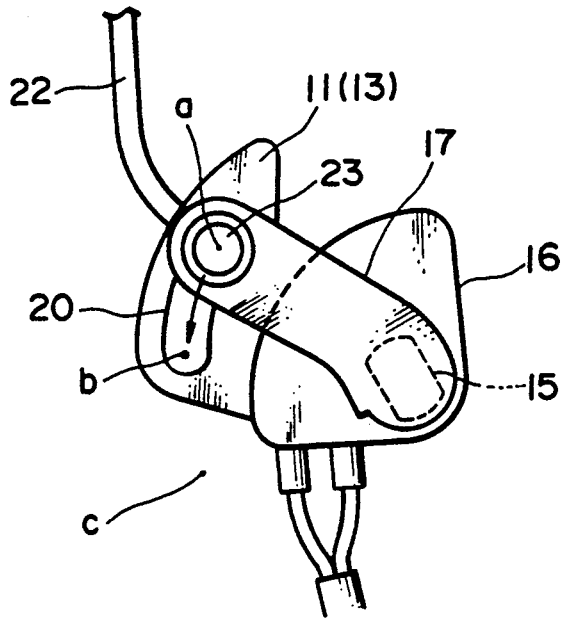
FIG. 8 is an explanatory view when the switch arm is at a lock position.

When the state shown in FIG. 8 is reached, the lock device of the door of the driver's seat enters the lock state due to the displacement of the lock levers 13, 14, the switch member is switched due to the displacement of the arm 17 and the lock devices of the other doors are switched to the lock state, too.

Figure 9:
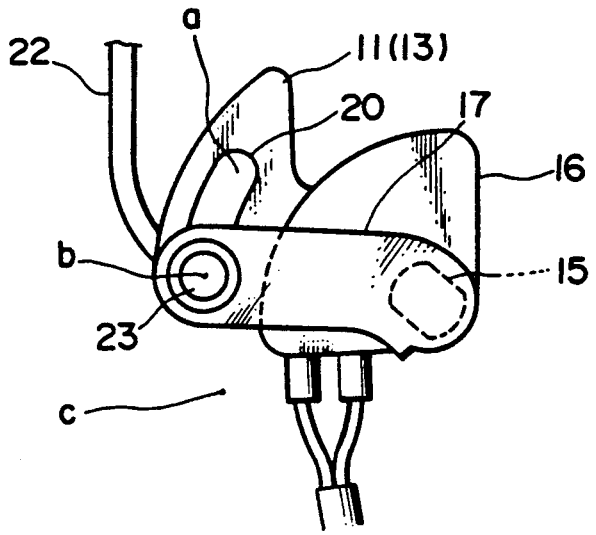
FIG. 9 is an explanatory view when the switch arm is at a neutral position.

Next, when the key cylinder is returned to the neutral position in order to pull the key from the key cylinder, the tip 23 of the rod 22 descends inside the arcuate hole 20 of the lock lever together with the arm 17, moves to the neutral position and stops there (FIG. 9). Therefore, the lock lever does not move, the lock device of the driver's seat is kept under the lock state, and the other lock devices remain locked because the switch member does not operate, either.

On the contrary, the lock device can be unlocked in the following way. The key cylinder is rotated to the unlock side from the state shown in FIG. 9 so as to lower the tip 23 of the rod 22 to the unlock position c. Then, the first and second lock levers 13, 14 rotate with the shaft 12 being the center and the switch arm 17 rotates with the shaft 15 being the center, respectively. The lock device of the door of the driver's seat is brought into the unlock state due to the displacement of the lock levers 13, 14 and the switch member is switched due to the displacement of the arm 17, so that the lock devices of the other doors are switched to the unlock state, too.

What is claimed is:

1. In a car lock device consisting of a body, a cover plate fixed to a surface of said body and a back plate fixed to a back of said body and fixed to a door, the improvement comprising:

a lock lever disposed between said body and said back plate, rotating with a center shaft in a longitudinal direction being the center and switching said lock device to a lock state and an unlock state;

a switch member fitted to an outer surface of said back plate, having a rotary shaft on the same axis as that of said center shaft, connected electrically to lock devices of other doors and sending a switch signal of at least either one of lock and unlock states to said other lock devices;

a switch arm fixed to said rotary shaft, rotating between said lock state and said unlock state and equipped with an engagement hole at an end portion thereof;

an arcuate hole formed at an end portion of said lock lever and having its center at said center shaft; and a rod having one of the end portions thereof meshed with said arcuate hole of said lock lever and with said engagement hole of said switch arm, and having the other end portion thereof interconnected to a key cylinder;

said arcuate hole having the length half the moving distance of said engagement hole of said switch arm by said key cylinder.

* * * * *